United States Patent [19]

Wolf

[11] Patent Number: 4,646,391

[45] Date of Patent: Mar. 3, 1987

[54] SPINNERS

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 642,666

[22] PCT Filed: Apr. 26, 1984

[86] PCT No.: PCT/DE84/00095

§ 371 Date: Aug. 1, 1984

§ 102(e) Date: Aug. 1, 1984

[87] PCT Pub. No.: WO85/04908

PCT Pub. Date: Nov. 7, 1985

[30] Foreign Application Priority Data

Apr. 27, 1983 [DE] Fed. Rep. of Germany ..... 3315247

[51] Int. Cl.[4] ..... D01H 5/74

[52] U.S. Cl. ..... 19/258; 19/239; 19/293; 73/862; 57/100

[58] Field of Search ..... 19/239, 240, 258, 293, 19/300; 73/862, 116; 57/100

[56] References Cited

U.S. PATENT DOCUMENTS

| | | | |
|---|---|---|---|
| 4,195,389 | 4/1980 | Schulz et al. | 19/293 |
| 4,314,388 | 2/1982 | Hartmannsgruber et al. | 19/293 |
| 4,336,684 | 6/1982 | Hartmannsgruber et al. | 19/293 X |
| 4,473,924 | 10/1984 | Hartmannsgruber et al. | 19/239 |
| 4,561,152 | 12/1985 | Niimi et al. | 19/293 X |

FOREIGN PATENT DOCUMENTS

| | | | |
|---|---|---|---|
| 2056202 | 3/1981 | United Kingdom | 19/240 |
| 745971 | 7/1980 | U.S.S.R. | 19/258 |

OTHER PUBLICATIONS

German Publication No. 2,650,287 published 5-1978.

*Primary Examiner*—Louis K. Rimrodt
*Assistant Examiner*—J. L. Olds
*Attorney, Agent, or Firm*—Karl F. Ross; Herbert Dubno

[57] ABSTRACT

A spinner is disclosed having at least one drawing roller arrangement, the bottom rollers of which are driven by at least one electric motor. For the purpose of identifying specific malfunctions and setting errors, a monitor is allocated to the electric motor, or to at least one of the electric motors, which monitors its power input and/or torque.

12 Claims, 4 Drawing Figures

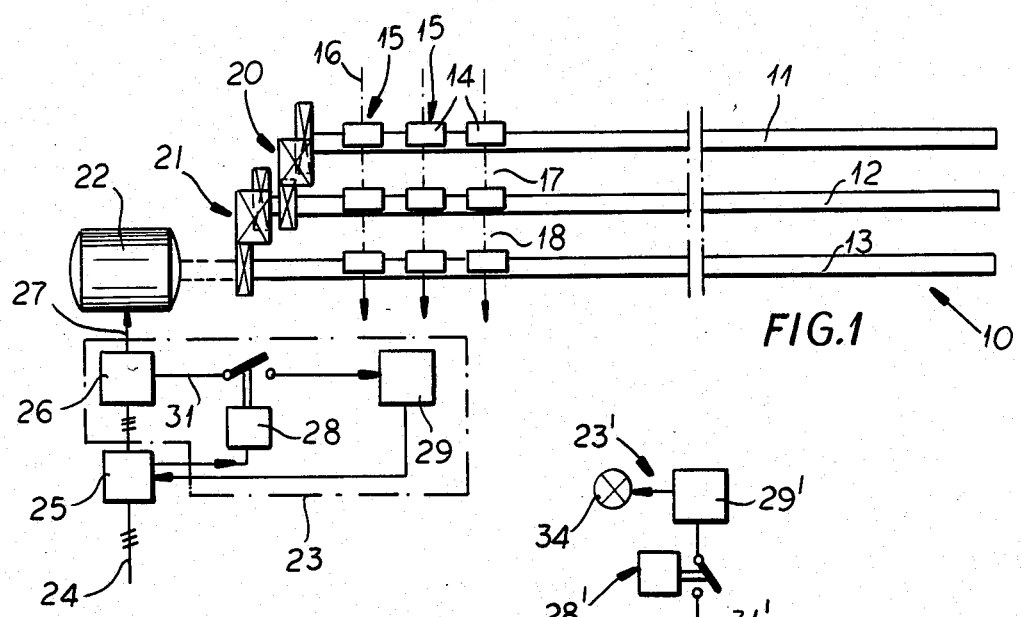
FIG.1
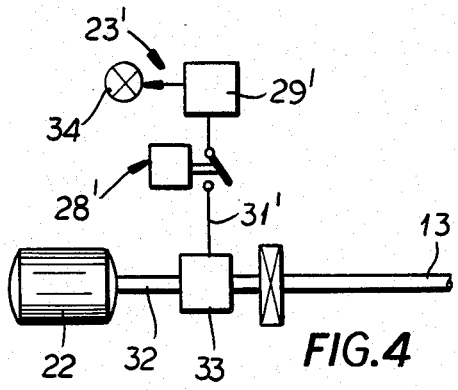
FIG.4
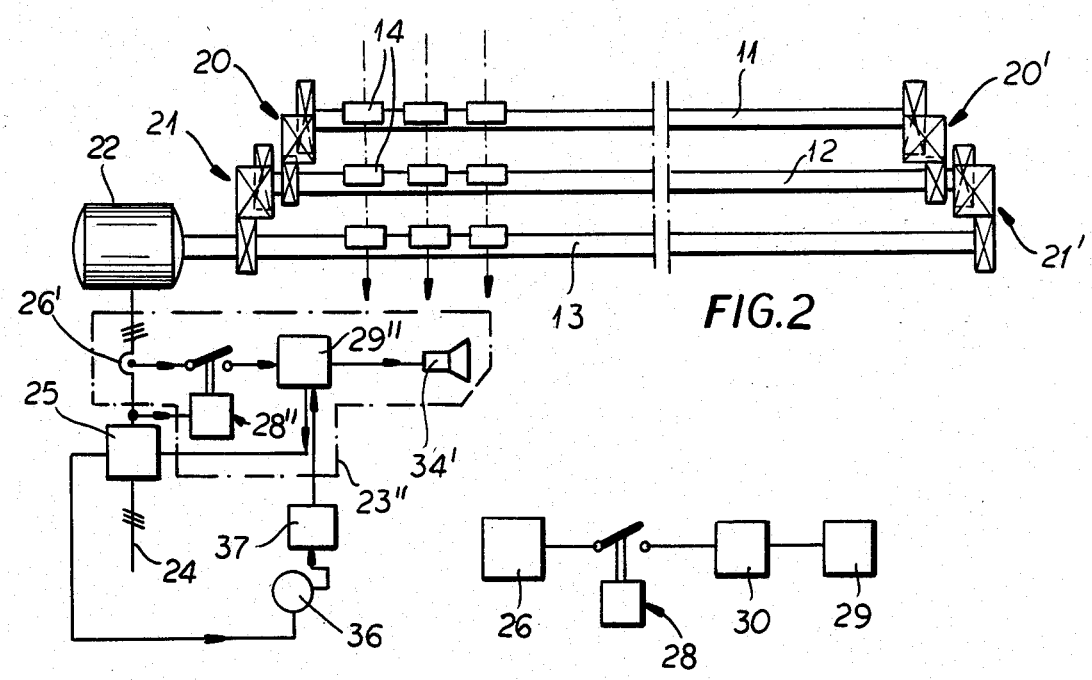
FIG.2
FIG.3

SPINNERS

CROSS REFERENCE TO RELATED APPLICATIONS

This application is a National Phase application corresponding to PCT/DE No. 84/00095 filed Apr. 26, 1984 and based upon German application P No. 33 15 247.0 filed Apr. 27, 1983 under the International Convention.

FIELD OF THE INVENTION

Spinners of this type have a drawing roller arrangement either on both long sides of the machine or only on one of the sides. The latter particularly applies to flyers and similar speeders. On the other hand, in the case of ring spinners, it is quite common to provide drawing roller arrangements at both long sides of the machine. The bottom rollers of a drawing roller arrangement can be driven by a common electric motor or by several electric motors, or, if there are two drawing roller arrangements, all the bottom rollers of these arrangements can be driven by the same electric motor. However, it also possible to drive two or several bottom rollers individually by separate electric motors.

In modern spinning mills, this type of spinner runs frequently without operator supervision as, due to the extensive automation, it hardly requires manual operation. For instance, in most cases the full spools or bobbins are replaced automatically by empty ones. Even thread breakages are often automatically eliminated by the thread fixing carriage which runs alongside the machine. However, through this extensive automation the machine may subjected to malfunction caused by fiber laps (also known as sliver laps, or laps for short) that may form in the bottom or top roller of the drawing roller arrangement as a consequence of thread breakages. If such a lap is not eliminated in time by hand, it will gradually increase in size and ultimately increasingly block sections of the drawing roller arrangement. This can damage the relevant drawing roller arrangement.

As far as long spinners are concerned, it is also known that at least the long bottom rollers, which limit the main drafting zones of the spinners' drawing roller arrangement or arrangements, are not interlocked at only one location by means of a toothed gearing, but at several locations which are arranged at great distances from one another, particularly at both longitudinal ends of the bottom roller. During a change in the draft caused by exchanging the gears of the toothed gearing, it may in some cases occur that, due to carelessness on the part of the operators, varying gears are inserted which, in turn, leads to varying gear ratios. After the machine has been started, the relevant roller arrangement is then considerably twisted to a varying degree, which may cause damage to the toothed gearing and the relevant bottom rollers.

It is, therefore, the task of this invention to eliminate malfunctions by a simple method, which may be caused by the errors described hereinabove.

SUMMARY OF THE INVENTION

With a spinner, this problem is solved by the distinguishing features of at least one drawing roller arrangement with a plurality of bottom rollers which are driven by at least one electric motor, characterized by the fact that the electric motor (22), or at least one of the electric motors, is provided with a monitor (23; 23'; 23'') for monitoring its power input and/or torque, which has a sensor (29; 29') responding to at least one predetermined high threshold value, i.e., an upper power input and/or torque limit value and/or an anamalous rapid power input and/or torque increase in time of the electric motor, which, as a consequence of an excess in the corresponding threshold value, releases the alarm device (34; 34') and/or switches off the electric motor (22) or the spinner.

As the described lap formation at the top or bottom rollers gradually slows down the bottom rollers and possibly the top rollers, due to the winding of sliver at the lap location, simply because such a lap pushes in between adjacent bottom and top rollers and thus increasingly slows down their rotation, each such lap causes, after some time, a considerable increase in torque, which is required for driving the relevant bottom roller or rollers, and consequently an increase in the power which is to be generated by the relevant electric motor or motors. Thus the power of an electric motor is $M \cdot \omega$, while M is the torque of the driving shaft of the electric motor and $\omega$ is its angular velocity. At a constant operating speed, the power input of the motor is thus proportional to its torque. The power input of the relevent electric motor is $U_{eff} \cdot I_{eff} \cos \phi$. An increase in torque, which has been caused by such a lap, can thus be determined by directly measuring the torque at the rotor shaft of the relevant electric motor or the torque of a shaft series-connected to the rotor shaft, or for example the driving torque of the relevant bottom roller, as well as by increasing the power input of the relevant electric motor. Assuming that the motor is operated at a constant voltage $U_{eff}$ (effective voltage) with an approximately constant $\cos \phi$, then the torque of this motor is approximately proportional to $I_{eff}$, i.e., proportional to its effective current inpit. In this case, the power input can be determined by means of a simple ammeter, instead of a power meter, which measures the effective supply current.

The sensor may preferably be a threshold switch which responds when a predetermined, preferably adjustable, threshold value of the torque, or the power input of the increase in time of the relevant mangitude, is exceeded, and then automatically switches the spinner off and/or releases an alarm device to attract the operators' attention that the relevant malfunction must be eliminated. Also other sensors can be used, for example, electronic comparators. When the sensor responds to an anomalous rapid increase in time of the power inut or torque, the indicated value of the power input or torque can for this purpose be differentiated in time, and the differentiated value can be fed to the sensor.

Furthermore, care must be taken that, when starting the machine from stop position, the initial normal increase of the power input or torque does not release the sensor. If there is a risk that this might occur, this can, for instance, be countered by using a time switch when starting the machine, that switches the sensor and monitor off for a predetermined period, so that it becomes effective only after a predetermined period, e.g., after decay of the starting current. As each lap only increases relatively slowly, the monitor, in cases where it only monitors the lap formation, can be so adjusted that the monitor or its sensor is not effective until the spinner has reached operating speed.

On the other hand, if the monitor is also to respond to varying gear ratios of toothed gearings, which interlock the bottom rollers at large longitudinal distances, it is practical to ensure that the monitor is already operational when the machine is started from stop position or while the machine is in the process of starting, so as to monitor the operating speeds, which can be performed quite easily, because incorrect gear ratios very rapidly lead to extreme loads of the electric motor or motors which drive the relevant bottom rollers. For instance, it can also be ensured that the monitor is switched on over a very short and predetermined time after the machine has been started, while it is still in the initial start phase.

At the same time, one can also ensure that, to begin with, the threshold value of the sensor automatically adjusts itself to a very high level, and subsequently, preferably after the spinner has reached operating speed, automatically adjusts itself to such a low level that it also indicates lap formations. On the other hand, during the start the threshold value is set at such a high level that, in this case, the sensor can virtually only respond to incorrect gear ratios of the interlocking toothed gearings of the relevant strands of the bottom rollers, but not to lap formations which occur during the starting period.

It can preferably be ensured that the electric motor or motors, which drive the bottom roller or rollers of the relevant machine, exclusively serve to drive the bottom roller or rollers and thus do not drive any other part of the relevant spinner. This increases the sensitivity of the monitor's response. In some cases it is, however, possible that the relevant electric motor or motors, whose power input and/or torque, or whose increase in power input or torque output is monitored, apart from one or several bottom rollers, also drives at least one other section of the relevant spinner, for example, spindles, or at least one ring rail, insofar as the monitor is sufficiently sensitive to respond to lap formations or incorrectly adjusted gear ratios.

BRIEF DESCRIPTION OF THE DRAWING

The accompanying drawings illustrate embodiments of the invention. They show:

FIGS. 1 and 2 each show a drawing roller arrangement with driving gear and allocated monitor of a spinner, particularly a ring spinner, in the form of a schemetic drawing, FIG. 3 shows a variation of a section of the monitor illustrated in FIG. 1, FIG. 4 shows a variation of the monitor illustrated in FIG. 1.

SPECIFIC DESCRIPTION

FIG. 1 shows the sectional drawing roller arrangement 10 having three long bottom rollers 11, 12, 13 which extend almost across the length of the long side of the relevant spinner. The bottom roller 11, 12, 13 are pressed against the top rollers 14, as is normal, by means of top roller load carriers, which are not illustrated, of which only a few top rollers 14 are illustrated. A sliver 16, which is to be drawn, always passes through each drawing roller, as in 15, of the drawing roller arrangement 10. At the same time, it first passes through a preliminary drafting zone 17, which is limited by a pair of draw-in rollers and central rollers, and subsequently through a main drafting zone 18 having a more extensive draft, which is limited by a pair central rollers and delivery rollers. After the sliver 16 leaves the drawing roller 15, it is twisted into a single yarn by means of the ring spinner, which is not illustrated. The drawing roller arrangement may have several hundred drawing rollers 15, while each drawing roller is allocated to a spindle of the ring spinner. The number of drawing rollers corresponds with the number of spindles. All drawing rollers of the relevant drawing roller arrangement have the three long bottom rollers 11, 12, 13 in common. These bottom rollers 11, 12, 13 are interlocked by the two toothed gearings 20, 21. The bottom delivery roller 13 is driven directly by an electric motor 22 which serves only to drive the bottom rollers 11, 12, 13. The bottom rollers 11, 12, 13 are thus driven only unilaterally at their longitudinal ends, which are adjacent to the motor 22, by the motor in conjunction with the toothed gearings 20, 21.

In the event that the ring spinner is equipped with a second drawing roller arrangement at its other long side, it can also be driven with the electric motor 22, or it can be driven by a separate motor which then will have a monitor similar to the one 23 allocated to the motor 22. In order to drive its other operating elements, such as the ring rail and spindles, the ring spinner is equipped with at least one other separate electric motor, which is not illustrated. However, in many cases it is also possible to use the illustrated electric motor 22 for driving at least one other operating element, e.g., for driving the spindle of the relevant long side of the machine.

The electric motor 22 is supplied via a common three-phase network 24 with constant power supply and variable supply current according to the requirements of the motor 22. A contactor 25, which serves to switch on and off the electric motor 22, is interconnected in the power feed line. The power $P=U_{eff} \cdot I_{eff} \cdot \cos \phi$ absorbed by the motor 22 through a feed line is constantly measured by a power meter (dynamometer) 26 of the monitor 23 which is interconnected in the feed line. The sampling measurement of the power meter 26 is transmitted via a time switch 28 to a threshold switch 29. The threshold switch forms a sensor which responds to an excess in the predetermined and adjustable upper limit value of the power input of the motor 22, which is measured by the power meter 26. The power input P of the motor 22 is approximately proportional to its power output and thus to the torque M which is effected by the motor to its drive shaft at a constant angular velocity, because $P=M \cdot \omega$. If the need arises, a dP/dt (t=time) forming differentiating element 30, as illustrated in FIG. 3, which differentiates the power P in time, is connected before the threshold switch 29, and in this case, the threshold switch 29 does not respond to an adjusted upper limit value of the motor's power input, but to a predetermined increase dP/dt of the power input of the motor 22.

During each response of the threshold switch 29, it triggers the opening of the contractor 25, so that the motor 22 is switched off. The contractor 25 can, at the same time, switch off the entire spinner in a manner not described herein.

The monitor 23 of FIG. 1 operates as follows:

Each time the contactor 25 is switched on, the time switch 28 is switched on which, first of all, interrupts the line 31 and renders the monitor 23 ineffective. After the switching time of the time switch 28, the time switch closes the line 31 and consequently connects the threshold switch 29 over a predetermined short period, e.g., one second, to the power meter 26 after the electric motor 22 and consequently the spinner has been switched on, so that the monitor 23 now becomes effective. This delay is to prevent an unfounded response of the threshold switch 29 while the machine is in the process of being switched on. Insofar as the drawing rollers 15 of the drawing roller arrangement 10 run normally, the monitor 23 will not respond. On the other hand, if there is a lap formation in a drawing roller 15, which has reached such a magnitude that, as a consequence, the top or bottom rollers of the drawing roller arrangement are retarded to such an extent that it leads to a considerable increase in power input of the electric motor 22, which is in excess of the set threshold value of the sensor 29, the threshold switch 29 responds and thus automatically switches off the contactor 25 and consequently the electric motor 22 and the entire spinner. At the same time, the alarm device can be released, which calls the operator, who eliminates the malfunction and puts the machine back into operation. The alarm device can, for example, release an acoustic and/or optical signal.

In addition to or instead of the monitor 23 described herein, a monitor 23′ can be provided for monitoring the driving torque of the electric motor 22 for rapid increase and/or excess of a perdetermined and adjustable limit value. Such a monitor 23′ is illustrated in FIG. 4. A torque measuring device 33 is arranged on the driven shaft 32 of the electric motor 22, which measures the torsion of a predetermined zone of this driven shaft 32, e.g., by means of a resistance strain guage or some other means, and transmits the obtained value via a time switch 28′, which closes the line 31′ by time delay after the motor 22 has been switched on, to a threshold switch 29′ which forms the sensor. In principle, the time switch 28′ can be like the time switch 28 illustrated in FIG. 1. As soon as the time switch 28′ has closed the line 31′, the sensor 29′ is connected to the torque measuring device 33, and responds to an excess of the predetermined and set threshold value of the measured torque by emitting a signal to an optical alarm device 34. The optical alarm device 34 then signals to the operator that a lap formation causing an excessive drive torque or, if the occasion arises, any other malfunction causing such an excessive torque, has occurred, so that the operator can eliminate this malfunction. In the event that it is intended to differentiate in time the torque signal of the torque meter 33, the threshold value then responds to a predetermined rapid increase in torque of the motor 22. Of course, it also is possible for the threshold switch 29′ to switch off the contactor 25 during each response.

In the embodiment according to FIG. 2, the long bottom rollers of the drawing arrangement illustrated therein interlock at both ends with toothed gears 20, 21, 20′, 21′, whereby the length of the bottom rollers 11, 12, 13 can be considerably larger than is the case with the unilaterally driven bottom rollers as illustrated in FIG. 1. However, these pairs of toothed gearing 20, 20′, or 21, 21′, which interlock the bottom rollers must alway have identical gear ratios, and if during a change of transmission ratio two toothed gearings 20, 21′, or 21, 21′, which interlock these bottom rollers 11, 12, 13, are accidentally adjusted to a varying transmission ratio, this can lead to considerable malfunctions. Any incorrect transmission ratio causes a rapid increase in the driving torque of the electric motor 22 and, consequently, in the power input. In this embodiment, the power input is likewise monitored by a monitor 23″, which in this embodiment is equipped with an ammeter 26′, which senses the magnitude of the supply current flowing from the contactor 25 to the electric motor 22 and feeds the obtained value via a time switch 28″ to a threshold switch 29″ which serves as a sensor. The time switch 28″ is like the time switch 28 illustrated in FIG. 1, and thus performs the same function. If there is no risk of an excessive starting current when the motor 22 is switched on, the time switch 28″ does not have to be used. The supply current of the motor 22 is constant, and its cos $\phi$ is also approximately constant. The supply current is, therefore, a guideline for the power absorbed by the motor 22. In the event that a considerable increase in the power input of the motor 22 is caused by accidentally varying transmission ratios of the toothed gearing 20, 20′, or 21, 21′, which clearly exceeds the normal, i.e., the set threshold value, the threshold switch 29″ responds by means of an acoustic alarm device 34′ by switching off the contactor 25 and, at the same time, by releasing an alarm. Furthermore, a changeover switch 37, which is activated by a time switch 36, is allocated to the threshold switch 29 whereby, after the monitor 23″ has been switched on, the threshold value, which is too high for the lap and is exceeded only due to an incorrect transmission ratio, is switched to a lower thereshold value which also responds to laps. The time switch 36 is switched on by the contactor 25 together with the time switch 28″. However, the switch 36 does not switch over to the lower threshold value of the threshold switch 29″, unless the spinner has reached operating speed.

I claim:

1. A drawing roller arrangement with a plurality of bottom rollers which are driven by at least one electric motor, characterized by the fact that the electric motor, or at least one of the electric motors, is provided with a monitor for monitoring an output of said motor selected from the group consisting of power input and torque, which has a sensor responding to at least one predetermined high threshold value selected from the group consisting of an upper power input, torque limit value, an anomalous rapid power input and a torque increase in time of the electric motor, which, as a consequence of an excess in the corresponding threshold value, activates a corrective action selected from the group consisting of releasing an alarm and switching off the electric motor or the spinner.

2. A drawing roller arrangement as defined in claim 1, characterized by the fact that the electric motor exclusively serves to drive at least one bottom roller of the drawing roller arrangement or drawing roller arrangements.

3. A drawing roller arrangement as defined in claim 1, characterized by the fact that a monitor is allocated to an electric motor which drives at least two long bottom rollers of said drawing roller arrangement, which are interlocked by toothed gearings in at least two locations that are arranged longitudinally distant from one another.

4. A drawing roller arrangement as defined in claim 3, characterized by the fact that the threshold value, at which the sensor of the monitor responds, can be switched over automatically from a higher to a lower threshold value after the drawing roller arrangement has been started.

5. A drawing roller arrangement as defined in claim 1, characterized by the fact that a monitor is allocated to an electric motor which drives at least two bottom rollers of the drawing roller arrangement, which are only unilaterally interlocked by at least one toothed gearing.

6. A drawing roller arrangement as defined in claim 1, characterized by the fact that the monitor has a device selected from the group consisting of a power meter for measuring the power input and an ammeter for measuring a current input of the electric motor, which is approximately proportinate to the power input.

7. A drawing roller arrangement as defined in claim 1, characterized by the fact that the monitor has a torque measuring device which measures the torque supplied by the electric motor.

8. A drawing roller arrangement as defined in claim 7, characterized by the fact that the torque measuring device measures the driving torque of at least one shaft which is series-connected to a rotor shaft of the electric motor.

9. A drawing roller arrangement as defined in claim 6, characterized by the fact that a differential element, which is used for the time differentiation of the indicated value of the element, is series-connected to a device selected from the group consisting of the power meter, the ammeter, and the torque measuring device.

10. A drawing roller arrangement as defined in claim 1, characterized by the fact that the monitor can only be switched on by time delay after the drawing roller arrangement has been switched on by means of a switching device.

11. A drawing roller arrangement as defined in claim 1, characterized by the fact that the sensor can only be switched on by time delay after the drawing roller arrangement has been switched on by means of a switching device.

12. A drawing roller arrangement with a plurality of bottom rollers which are driven by at least one electric motor, characterized by the fact that the electric motor, or at least one of the electric motors, is provided with a monitor, positioned distant from said rollers but communicating with said motor, for monitoring an output of said motor selected from the group consisting of power input and torque, which has a sensor responding to at least one predetermined high threshold value selected from the group consisting of an upper power input, torque limit value, an anomalous rapid power input and a torque increase in time of the electric motor, which, as a consequence of an excess in the corresponding threshold value, activates a corrective action selected from the group consisting of releasing an alarm and switching off the electric motor or the spinner.

* * * * *